United States Patent [19]

Prihoda

[11] Patent Number: 4,994,138

[45] Date of Patent: Feb. 19, 1991

[54] PRESS FOR WOOD COMPOSITES

[75] Inventor: Peter J. Prihoda, Burnaby, Canada

[73] Assignee: Compax Engineering & Development Ltd., Burnaby, Canada

[21] Appl. No.: 304,163

[22] Filed: Jan. 31, 1989

[51] Int. Cl.[5] ..... B30B 5/00

[52] U.S. Cl. ..... 156/580; 100/151; 156/583.5

[58] Field of Search ..... 100/151, 154, 93 RP, 100/152, 153; 156/583.5, 555, 580; 59/84; 305/58 R, 58 PC; 474/206, 212; 425/83.1, 371

[56] References Cited

U.S. PATENT DOCUMENTS

| | | | |
|---|---|---|---|
| Re. 6,728 | 11/1875 | Pease | 100/151 X |
| 204,757 | 6/1878 | Price | 100/152 |
| 220,249 | 10/1879 | McCormick | 100/152 |
| 1,224,445 | 5/1917 | Burpee | 305/58 |
| 2,027,657 | 1/1939 | Van Roggen et al. | 100/121 |
| 2,118,736 | 5/1948 | Odom | 305/58 RX |
| 2,142,932 | 3/1955 | Beard | 34/143 |
| 2,150,984 | 4/1957 | Near et al. | 100/154 |
| 2,868,356 | 1/1959 | Haaff | 198/833 |
| 3,045,586 | 7/1962 | Blood | 100/154 |
| 3,068,920 | 12/1962 | Chandler | 100/153 |
| 3,111,149 | 11/1963 | Schubert | 100/93 RP |
| 3,120,862 | 2/1963 | Burger | 100/154 |
| 3,587,451 | 6/1971 | Luthi | 100/152 X |
| 3,851,685 | 12/1974 | Ahrweiler et al. | 156/583.5 X |
| 3,852,012 | 12/1974 | Pfeiffer | 425/363 |
| 3,897,341 | 7/1975 | Ozawa | 100/152 X |
| 4,283,246 | 8/1981 | Held | 156/555 |
| 4,468,188 | 8/1984 | Gerhardt | 425/371 |
| 4,517,148 | 5/1985 | Churchand | 100/154 X |
| 4,647,417 | 3/1987 | Böttger et al. | 156/583.5 X |

FOREIGN PATENT DOCUMENTS

| | | |
|---|---|---|
| 402190 | 2/1974 | U.S.S.R. . |
| 587013 | 1/1978 | U.S.S.R. . |

*Primary Examiner*—Michael W. Ball
*Assistant Examiner*—Mark A. Osele
*Attorney, Agent, or Firm*—Trask, Britt & Rossa

[57] ABSTRACT

This invention relates to a novel method and press which are useful for the continuous production of structural wood composite products of large cross-section. A method of continuously forming a compressed structural wood composite product composed of an assembly of wood elements, comprising: a) heating and plasticizing the wood assembly before or during the initial stages of pressing the wood assembly; and b) compressing the heated and plasticized wood assembly so that the wood assembly permanently sets at a rate which corresponds to the rate of compression of the assembly.

12 Claims, 7 Drawing Sheets

PRESS FOR WOOD COMPOSITES

FIELD OF THE INVENTION

This invention relates to a novel method and press which are useful for the continuous production of structural wood composite products of large cross-section.

BACKGROUND OF THE INVENTION

Timber resources which provide whole wood for use in manufacturing wooden articles such as furniture and housing are becoming increasingly scarce with the passage of time. The use of composite materials constructed of wood elements has increased dramatically in recent years. Manufacturing of wood composite materials involves a degree of densification of the wood assembly as well as bonding wood elements together. Continuous presses have been used to densify and bond the wood elements together.

Two basic types of continuous press are described in the prior art. The first type uses a "caterpillar-type" conveyor chain as the means for transporting the wood element material through the press while simultaneously applying pressure. A major advantage of the conveyor chain is that it has a potentially high pressing capacity. However, it has reduced flexibility and cannot accommodate complex profiles. The second type utilizes an endless steel belt for conveyance and pressure application. The chief advantages of the endless steel belt system are flexibility and an ability to be bent over complex profiles. However, the endless steel belt system has restricted pressure application capability.

A common feature of existing continuous presses for the production of wood composites is the shape of the press profile. It typically consists of an infeed section of converging upper and lower endless belts or conveyor chains, followed by a straight section where the wood composite product is held at a constant dimension while being heated. The shapes and relative lengths of these two sections vary. An important criteria in specifying the length of the compacting section is the thickness of the wood composite being manufactured. A loosely layered wood element assembly at the infeed may typically be three times thicker than the finished pressed wood composite product. Therefore, while a short compressing infeed section may be sufficient for the production of thin panel products, a much longer compression infeed section is required in presses for manufacturing large profile structural wood composites. In a large profile press, the converging infeed section can be composed of linear converging surfaces or be formed of curved convex infeed surfaces. The significance of the actual shape of the press profile increases with increasing working depth.

Caterpillar-type conveyor chain designs are not extensively used in continuous press systems today because they have low flexibility. Straight rectangular links that form the conveyor chain can only be made efficiently to follow a straight path, if the links are at the same time designed to support the high pressures that are required in compressing large composite materials. In principle, if a straight rectangular plate (which the conveyor links in principle are) is forced to follow a curve, or is rotated, as is the case in a transition between two converging paths, the plate becomes supported on a single point or line. Tremendous forces are therefore encountered at localized areas. Thus, such situations are generally highly undesirable. Another serious deficiency of current conveyor chain-track systems stems from the low radius bending curvature that the material is forced to follow in a continuous transition between two different paths.

A further undesirable feature of a conveyor chain-track system is that overpenetration of the link into the product occurs as the link is being rotated through a transition stage as, for example, in transition from converging to parallel press section. The mechanics of the link's motion is such that it is forced to overcompress the wood assembly at its leading edge, and then to retract to follow the second trajectory of the press bed. Such over-penetration may be detrimental to the composite product. But mainly, it subjects the link to large forces at the time when it is insufficiently supported. For the above reasons, caterpillar type conveyor chain systems are presently restricted to low pressure applications, or are used in systems where only limited compacting is required.

Flexible steel belt systems overcome many of the disadvantages inherent in conveyor chain systems. Because of its flexibility, a thin steel belt can smoothly follow complex contours. However, a flexible steel belt system has drawbacks. It has low capacity to deliver power for compression of the wood composite. In addition, in order to transport the forces that the belt must deliver to compress the wood composite, the belt must carry stresses arising from traction tension created between the driving pulleys, and stresses developed by bending around the pulleys. An analysis of these stresses demonstrates that there is an optimum belt thickness and, therefore, a practical limit to the power that a steel belt system can transmit in a given situation. The amount of power required to manufacture a wood composite product is directly proportional to its cross-sectional size. Continuous steel belt systems inherently have sufficient capacity for production of thin panel products. But their capacity is insufficient for production of structural composite products of larger cross sections. This power deficiency is overcome in some existing systems by including in the system an additional pulling device, which is located after the press. This device can be a caterpillar conveyor chain type because no further compaction is involved. It is obvious that this approach involves a large degree of equipment duplication and thus is very costly. In addition, because pulling power is required to transport the composite assembly through the press, a full density product cannot be manufactured until some time after the assembly is sufficiently engaged in the pulling device. As a consequence, a large amount of reject material is produced at the beginning of a production run.

Because of the nature of the wood composite pressing process, the elements of the composite material, as it is being compressed, are subjected to bending. In a symmetrical press, the elements that are proximate to the press bed (that is, they are in the exterior regions of the assembly) are bent more than the elements in the interior of the assembly. As a consequence, the associated bending stresses will vary among the elements from the exterior to the interior. During the process of compaction, the elements are often fused into a single composite beam by forming pressures well before completion of the compacting process. This leads to the development of additional interior stresses in the composite. In the compacting stage, the composite beam has a wedge shape between any two cross sections, and therefore the outside wood elements near the press bed must span a longer distance than those in the centre of the beam. As the compaction process progresses, a strain gradient therefore develops throughout the cross-section, resulting in the development of compressive stresses in the wood fibre near the exterior of the composite beam and tensile stresses near the centre of the beam. At the end of the compaction cycle, the press created wedge shape of the beam is eliminated and the beam becomes uniform in its cross-section. In principle, the process of creating a straight cross-section from a wedge shape cross section is similar to force-bending a curved beam into a straight beam. The developed stresses will vary from tensile in the outer fibres to compressive in the centre of the beam.

Ensuing stresses in the composite product are a combination of the multiple stresses as described above. Their respective magnitudes depend on such factors as the depth of compaction, curvature of compaction, type and conditions of the wood components, and their interfaces. Eventhough the stress distribution throughout the cross-section of a composite beam is of a complex nature, some generalizations can nonetheless be made. Smaller compacting curvature will create stress distribution predominantly tensile along the outer fibres and compressive in the centre of the beam. As the compacting curvature is increased this dominance will diminish and the stresses due to the depth of compression will gain in significance. Conceivably, at a specific press curvature, the state of stress in the beam will be at minimum.

Apart from the foregoing, wood as a natural material exhibits significant rheological behaviour. Only a portion of the stresses developed during manufacturing will remain in the finished product as residual stresses. If the compression is asymmetrical, these stresses may cause a bow to form in the finished product. In the case of symmetrical compression, a problem may appear when the symmetry is upset by further processing. These considerations apply equally to caterpillar track systems and flexible steel belt systems.

Without exception, the prior art dealing with wood composite manufacture describes presses consisting of a linear compression span which is sometimes preceded by a converging compressing section.

U.S. Pat. Nos. 3,852,012, 3,851,685 and 4,283,246 disclose continuous presses using endless steel belts as the transporting and power transmitting means. They include compacting capability at the press infeed.

U.S. Pat. Nos. 3,111,149 and 4,468,188 describe presses that use endless steel belts, but they do not offer compacting capability.

The presses that are disclosed in these patents are capable of providing the required compacting contours, and thus are suitable for small sections, but they lack the power required to compact larger cross-section composites.

Other prior art describes continuous caterpillar and chain conveyor presses but these are useful only in low pressure applications where no large compaction is involved. U.S. Pat. Nos. 2,142,932; 2,027,657; 2,868,356; and 3,068,920 fall in this category. The press that is described in U.S. Pat. No. 3,120,862 is of the caterpillar chain type and suggests compaction at its infeed. But the specification is silent on the problem of supporting straight links in transition between two trajectories. This problem is also not recognized or acknowledged in U.S. Pat. No. 3,045,586, which teaches the use of a conveyor chain as a pressing means.

A method of including compaction in a caterpillar chain type continuous press can be found in U.S.S.R. patent No. 587,013. The caterpillar chain is equipped with rollers that in turn roll on stationary supports. As a method of press construction, this arrangement is undesirable because it limits maximum press pressures, it is maintenance intensive, and it demands special lubrication procedures. Further complications arise if press heating is included.

A somewhat similar design appears in U.S.S.R. patent No. 402,190, where an additional heating section is included, but it is remote from the caterpillar chain section. Compaction is achieved by using converging endless steel belts over an extended length. Construction of the caterpillar chain is similar to that described in U.S.S.R. patent No. 587,013. The rolling means is attached to the caterpillar chain. Compaction is achieved by the means of endless steel belts powered through friction by the caterpillar chain.

U.S. Pat. No. 4,517,148 is pertinent because it points out the significance of the size of the compressing radius in the case of a specific elongated lumber composite made of narrow strands and using a steel belt press. A radius of curvature of 30 to 50 feet is assumed to be sufficient for the production of such material. The system appears to be designed for use with a conventional press.

None of the prior art cited makes use of the rheological characteristics of wood to improve the pressing procedure of wood composites, or attempts to synchronize compression and stress relaxation, or uses a fully curved press profile, or addresses or solves the problem of transition and full support of a track segment travelling on two or more trajectories of different curvatures.

SUMMARY OF THE INVENTION

This invention is directed to utilizing the time dependency of the strain/stress relationship in wood and the accelerated permanent set rate experienced at higher temperatures and moisture contents in a continuous press that overcomes major problems associated with conventional continuous press designs, and is adapted to handle large-profile wood composites.

The press comprises two converging endless chain-track assemblies, each composed of a set of power chains and a plurality of track segments. The segments span the working width of the press between the two power chains. Both chains have long common pins that interconnect the chains. These pins provide retention and pivoting means for the segments. The track segments have a large constant radius curvature in the longitudinal direction of the press. The pressing zone of the press is defined by top and bottom press platens that have faces which support chain-track assemblies that are formed to a curvature of radius corresponding to the curvature of the track segments. No linear pressing section is present. The radius of the constant press curvature is such that the rate of compression in any particular application is similar to the rate of strain relaxation in the wood being pressed. Antifriction bearings provide a rolling means between the tracks and the press platen.

The invention pertains to a method of continuously forming a compressed structural wood composite product composed of an assembly of wood elements, comprising: (a) heating and plasticizing the wood assembly before or during the initial stages of pressing the wood assembly; and (b) compressing the heated and plasticized wood assembly so that the rate of permanent setting of the wood assembly corresponds to the rate of compression of the assembly.

A method wherein full permanent set of the assembly is achieved at about the same time as maximum compression is applied. The heated assembly contains thermosetting glue and the wood assembly is compressed rapidly at a first stage and compressed slowly at a second stage. A method wherein development of excessive residual stresses within the wood assembly is prevented by minimizing bending curvature to which the wood elements of the wood assembly are subjected.

The invention is also directed to an apparatus for continuously pressing an assembly of wood elements into a wood composite comprising: (a) upper and lower frame means, each supporting a pressing means, the pressing means comprising pressing platens facing each other and having the facing surfaces thereof formed into respective convex curved shapes, the facing surfaces defining a converging opening, one end of which receives the uncompressed wood assembly and the opposite end providing an outfeed for the compressed wood assembly; (b) upper and lower converging endless track means constructed to conform to the respective curved shapes of the upper and lower pressing means; (c) upper and lower antifriction bearing means located between the curved surfaces of upper and lower pressing means and the respective curved surfaces of the upper and lower track means; and (d) power means for moving the upper and lower track means.

In the apparatus, the power means consist of a pair of endless chain means, the pair of endless chain means being located on opposite ends of common pins and being held in place by the pins, the pins extending through the track means. The track means consist a series of adjacent separate segments having in the facing surfaces therebetween locating seats for the pins, the faces of the segments facing the pressing means being formed to have a radius corresponding to the radius of the pressing means. An apparatus wherein the endless track means is located between the pair of endless chain means and the pins secure the pair of endless chain means to the endless track means and retain the segments in an endless loop assembly.

An apparatus wherein the pressing means is composed of a plurality of separate sections. An apparatus wherein the endless chain means is a caterpillar chain conveyor having the conveyor links formed to a constant radius curvature conforming to the curvature of the pressing means.

In the apparatus, the radius of curvature of the pressing means can be at least 300 feet. In the apparatus, sealing means can be located on the exterior surface of the track means. The sealing means can be a thin flexible steel belt. In the apparatus, the radius of curvatures of the upper and lower pressing means can be about equal. An apparatus wherein the facing endless track means define a curved converging section from the press opening to a point of maximum convergence between the opening and the outfeed, and a curved diverging section from the maximum convergence point to the press outfeed.

The invention also pertains to a method of bridging the transition of a plurality of transporting track elements between two paths of unequal curvature utilizing a rotating surface and a curved stationary surface, the stationary surface having the same radius of curvature as the transporting track elements, the rotating surface having on its circumference a plurality of curvatures of the same radius as the respective transporting track elements, the relative position of the stationary and rotating surfaces being such that when a track element is at the start of the transition point, its curved surface is precisely aligned with the curvature of the stationary surface while being fully supported by the rotating surface, the centre of the rotating surface lying on a line perpendicular to the longer face of the element and being divided into two equal counterparts of each other.

A method wherein two unequally curved parts of a stationary platen are utilized, each part consisting of plurality of narrow sections that are mutually staggered, the corresponding curvatures being alternatively machined along the length of each track element such that the correct curvature on the track element is in a location where it is supported by a correspondingly curved section, the relative positions of the two curved surfaces being such that when a track element is located at the start of its transition point its curved surface is precisely aligned with the curvature of the second part of the platen while being fully supported by the first part of the platen, the centre of curvature of the first part of the platen lying on a line perpendicular to the element's longer face and dividing the curved surface of the track element in transition into two mirror images of one other.

BRIEF DESCRIPTION OF THE DRAWINGS

The substance and nature of this invention in certain embodiments is illustrated in the following identified drawings. The drawings should not be interpreted as restricting the spirit or scope of the invention in any way.

DETAILED DESCRIPTION OF A SPECIFIC EMBODIMENT OF THE INVENTION

Figure 1:
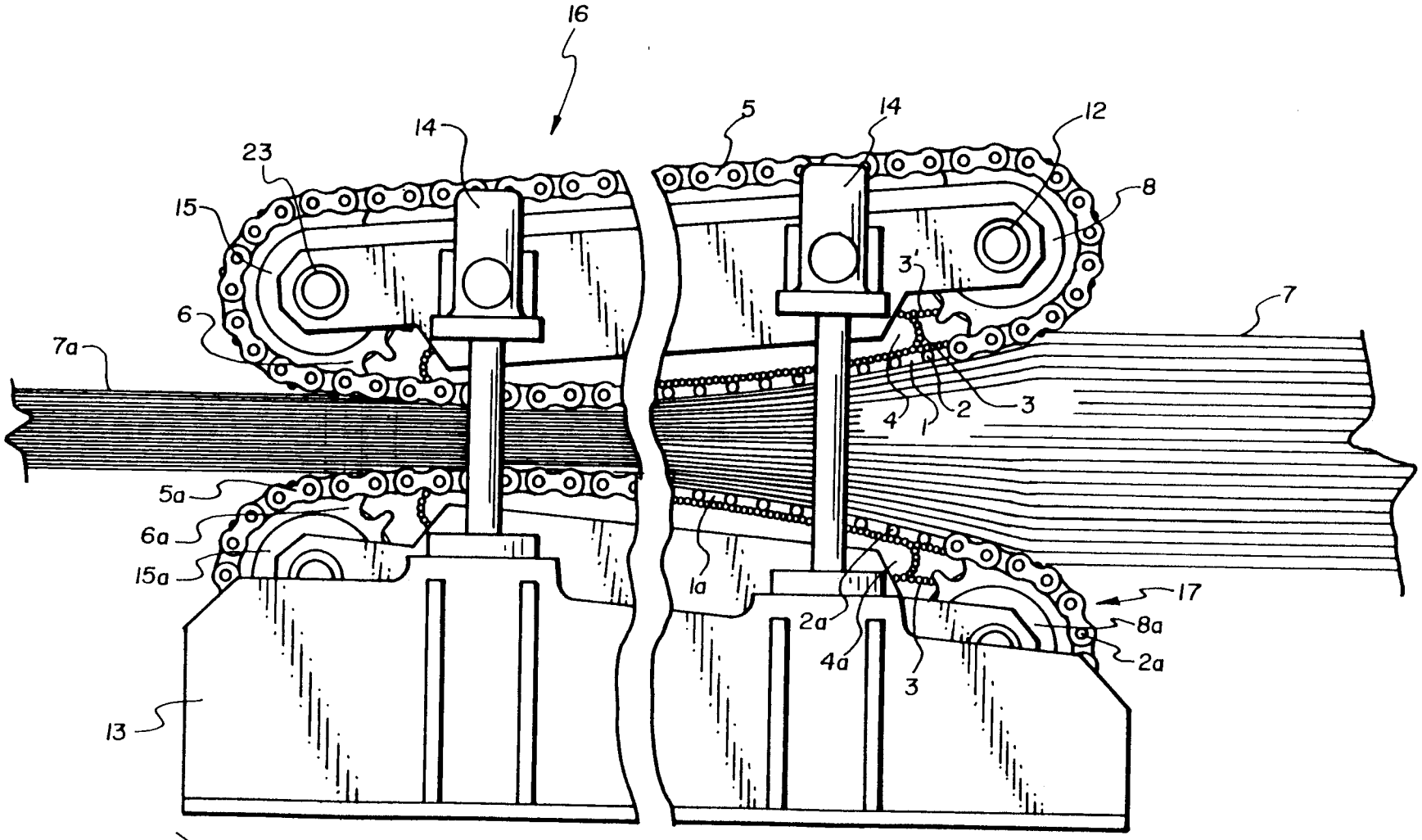
FIG. 1 depicts a schematic side elevational partial cross-section view of a continuous press of the present invention.

The treatment that is given to the wood elements during the heating and pressing stages of the wood composite manufacture is critical in achieving maximum product quality and structural strength. It is preferable and beneficial to the end composite product to plasticize the wood cell components before the pressing cycle is commenced. The press must compress the assembly to a wood density usually higher than the free density of the wood elements. This must be achieved without causing excessive breakage of the wood structure or inducing crack propagation in the elements. The heating and pressing stages can be separate or can be carried out simultaneously.

The rheological behaviour of some solid materials, such as wood, has been a subject of study for some time. The time dependency of stress and strain in wood has been found to be important in numerous applications. The wood composite materials show the same behaviour as the parent material, namely pure material wood. The significance of the time-dependent behaviour in wood composites is amplified by the fact that these materials are stressed not only in service, but also during their manufacture.

When wood is subjected to an instantaneous deformation, resisting internal stresses develop in the wood. If the deformation force is removed without delay, recovery from the deflection is complete. However, if the deformation deflection persists for a period of time, a certain portion of the wood will not recover and a permanent set therefore remains. Strain in wood, at any particular time, consists of three basic components: an elastic component, a delayed elastic component, and a viscous component. The elastic component of wood is recovered immediately upon removal of the deflection load. The delayed elastic component is also fully recovered, but over a period of time, when the load is removed. The viscous component is not recovered and is responsible for forming a permanent set in the wood. The relative magnitudes of these three components depends upon the time that elapses between the application and removal of the load, as well as the type and condition of the wood. Temperature and moisture content are also important contributing factors.

Viscous deformation in wood results from failure and reconstitution of chemical bonds in the wood matrix. When a chemical bond in a wood fails under critical load, the load is transferred to other areas of the wood matrix and new bonds are formed. When the load is removed later, the newly formed bonds prevent the wood matrix from returning to its original non-deformed configuration. Delayed elastic deformation originates in the uncoiling and recoiling of molecules, reformation of some severed secondary bonds and entanglements of molecules in the wood matrix.

Elevated temperature and elevated moisture content can result in rapid changes within the wood structure. As with any substance, the temperature of wood is a measure of its internal energy. This energy is exhibited in the form of vibrational and rotational energy of the various constituent atoms and molecules. The increased energy level through elevated temperature and weakened bonds due to high moisture content make it relatively easy to modify the internal molecular structure of the wood, if that is an objective. In practical terms, elevated temperature and high moisture level lowers the strength of the intermolecular bonds in the wood and modifies the relative magnitudes of the deflection constituents. Under such conditions, the viscous deflection component may become the dominating component. At prolonged load durations, and under elevated conditions, the elastic component becomes small. The magnitude of the permanent set achieved at an elevated temperature and moisture content may then approach the total deflection during compression in significantly shortened time. As practised in the method of the present invention, and as outlined in detail later, at a slow compression rate and at elevated temperature and high moisture content, transformations within the wood matrix occur simultaneously with compression rate. A proper selection of compression rate therefore eliminates the necessity of holding the compressed wood assembly at a constant press opening.

In general, as illustrated in FIG. 1, the invention in one specific embodiment comprises two opposing parallel chain-track assemblies which are formed of alternating interlinked segments 1 and 2. These assemblies are both supported and carried by a plurality of antifriction roller or ball bearing means 3 and 3' respectively. Antifriction bearing chains 3 and 3' in turn roll on respective pressing means comprised of press platens 4, which are constructed of a plurality of sections. The opposing platens 4 are constructed so that they have a rolling surface that is shaped into a single radius. This radius forms the working surface of the press, and governs the rate of compression of the loose wood composite assembly.

As can be seen in FIG. 1, which depicts a schematic side elevation partial cross-section view of the continuous press of the invention, the opposing upper and lower curved chain-track assemblies 16 and 17 smoothly compress the wood components 7 into a pressed narrow wood composite 7*a* (as seen at the left of FIG. 1). The upper and lower pairs of chain-track-pin assemblies 1, 1*a* and 2, 2*a* and upper and lower power roller chains 5 and 5*a* are driven respectively by a pair of upper and lower forward sprockets 8 and 8*a* and rear upper and lower sprockets 15 and 15*a*. The sprockets 8 and 8*a* and 15 and 15*a* have circumferential teeth 6 and 6*a* which mesh into the respective chains 5 in order to impart driving power to the chain-track assemblies. The upper and lower track assemblies are supported by press support 13. A pair of hydraulic presses 14 regulate the opening between the two opposing chain assemblies 1, 1*a* and 2, 2*a* and can be adjusted to vary the size of the opening.

The curvature in FIG. 1 is exaggerated to illustrate the substance of the invention. The magnitude of the press radius is dependent on the specific application criteria in each case. As an example, in a press where the total wood composite compaction involved is 24 inches, and the rate of compression criteria to balance compression rate with plasticization rate requires a minimum pressing radius of 1000 feet, the maximum compression should be reached in 45 feet. The rate of compression varies from a maximum at the beginning of the cycle to zero at the horizontal tangent point. In this example, compaction starts at the rate of 0.045 inches/inch at the infeed to the press. Forty-one feet from the start, the compression rate diminishes to 0.004 inches/inch. For practical purposes, such a slow compression rate can be considered as near zero.

In the embodiment illustrated in FIG. 1, the press bed does not terminate at the horizontal tangent point but continues upwardly with a constant curvature until the compacted product is no longer in contact with the press. The press section between the low compression point and its corresponding low relaxation rate point of, for example, 0.004 inches/inch can be considered as the zero rate span. This section, in this example, is approximately 8 feet long. In general, the press curvature will be chosen to correspond with the pressing speed such that the compression rate and the internal wood strain relaxation rate are similar.

The upper and lower track segments 1 and 1*a*, and pins 2 and 2*a* are supported respectively by upper and lower platens 4 and 4a. To ensure correct support of the track segments 1 and 1a and pins 2 and 2a by the platens 4 and 4a respectively the segments 1 and 1a have their wide faces formed to a radius such that, when assembled in the press, the centres of these radii coincide with the centre of the radius of the platen's curvature.

Figure 2:
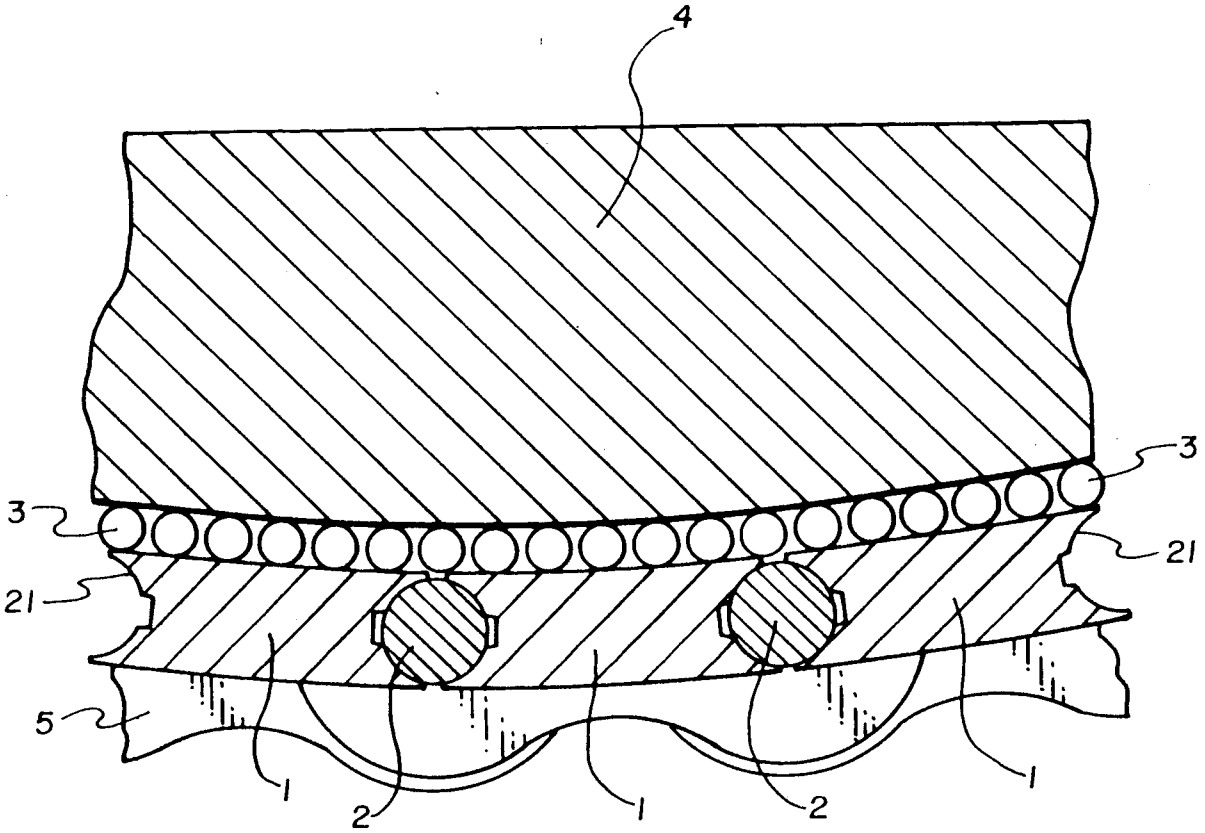
FIG. 2 represents an enlarged partial cross-section view of the track/platen assembly shown in FIG. 1.

FIG. 2 illustrates in side-elevation partial cross-section detail the curved orientation of the separate segments of the track assembly 1 and pins 2. The curvature of the platen 4 and the series of segments 1 is greatly exaggerated in order to clearly illustrate the essence of this invention. In practice, the radius of press curvature will be very large, for example, 1000 feet. As mentioned previously, the individual segments 1 have both their upper and lower wide faces curved to conform to the radius of curvature of the platen 4. Antifriction bearings 3 and 3' on which the separate segments 1 ride, are located between the curved surface of platen 4 and the upper faces of segments 1 (as seen in FIG. 2). The narrow edges of the segments 1 are provided with curved notched seats 21 to accommodate the pins 2 extending between the two pairs of chains 5 (see FIG. 3). It should be apparent that the pitch (the distance between the seat centres) of the track segments 1 must be identical to the pitch of the chain 5. It should also be understood that the shape of the seats 21 may assume alternate shapes than as depicted in FIG. 2, so long as they serve to accommodate pins 2 (and 2a on the lower press assembly).

The bearing supports 3 for the track and pin assembly 1 and 2 (see FIG. 2) consist of a plurality of roller chains 5. The width of the individual roller chains 5 should not be excessive so as to avoid misalignment during operation.

The bearing supports 3 and 3' may in the alternative be formed by a multitude of steel balls running in machined grooves (races), similar to those used in conventional ball bearings. Such an arrangement requires that the grooves have an appropriate longitudinal curvature in addition to the lateral curvature required to match the curvature of the ball. The grooves may be provided in the platen 4 only, or they may be machined in the segments 1 as well. Obviously, grooved platens 4 or segments do not require a curved surface between the grooves. Specifications for the bearing support, such as width of the rolls and chains, diameter of rolls or balls, number of rolling elements, etc. can be determined by applying well-known engineering principles and methods as taught and established in the wood composite machinery industry.

Figure 3:
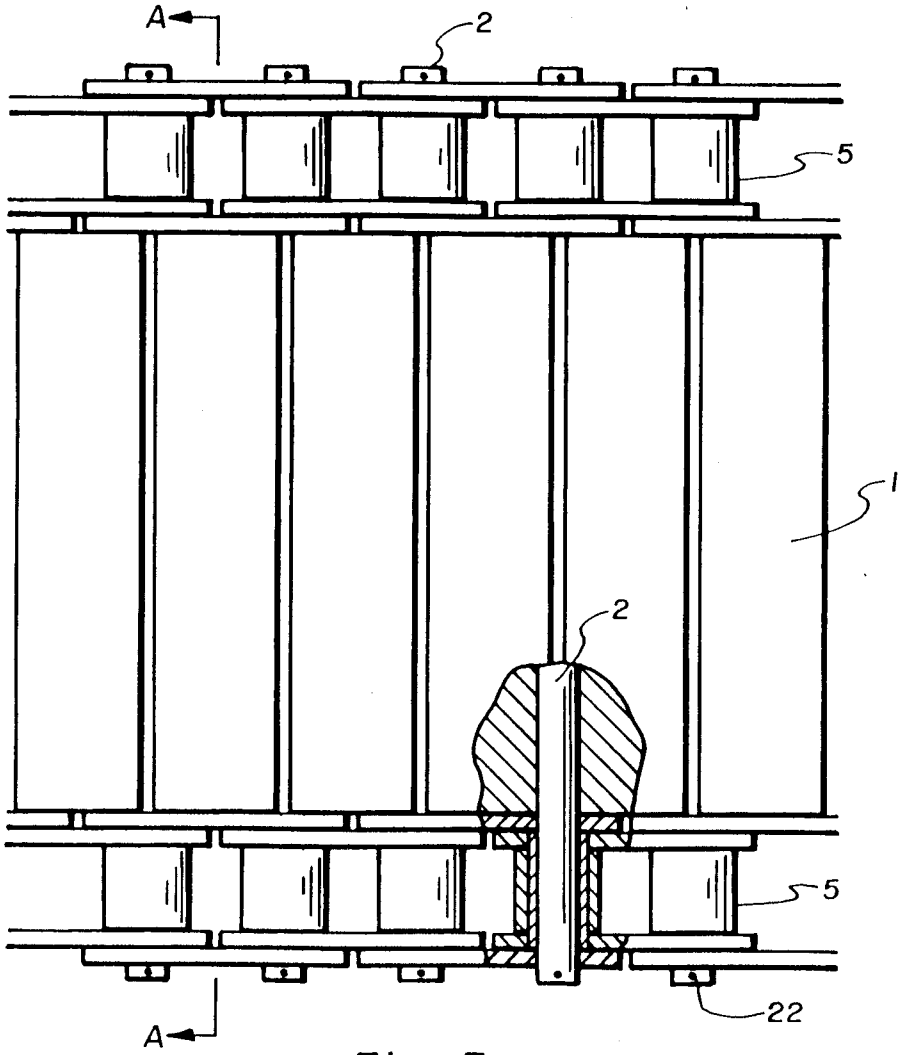
FIG. 3 represents a plan view of the dual chain-track segment assembly.

As illustrated in plan view in FIG. 3, the chain-track assembly 1, 2 and 5 comprises at each side of the plurality of segments a pair of endless power roller chains 5 of sufficient strength and capacity to deliver the power that is required to drive the press assembly 16 under load conditions. As depicted in FIG. 3, two single-strand chains 5 power the press track assembly 1 and 2. To increase press capacity, multiple-strand chains may be used instead of single-strand chains. Pins 2 extend between and are common to both parallel chains 5. Pins 2 in combination with chains 5 provide retention means for the individual segments of the assembly 1 and hold them in position. Cotter pins (not shown) can be inserted through the holes 22 at the ends of the pins 2 to hold the chains in position.

Figure 4:
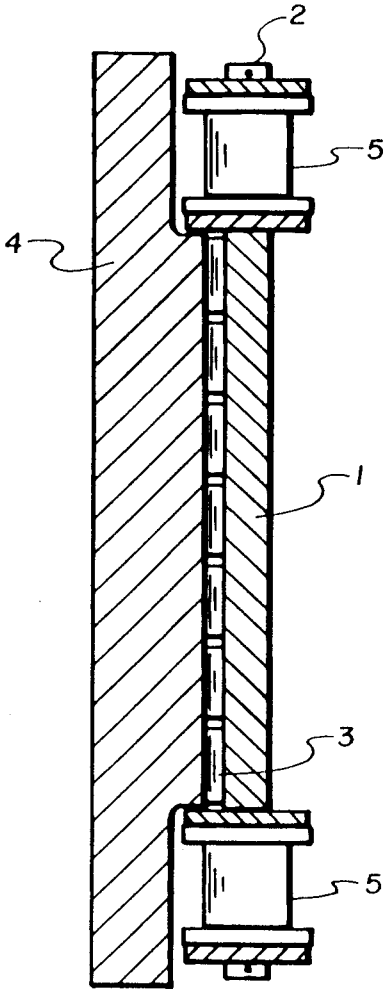
FIG. 4 represents a cross-section view through the chain-track assembly taken along section line A—A of FIG. 3.

FIG. 4 illustrates in end cross-section view, taken along section A—A of FIG. 3, the relational construction of the assembly components. Segment 1 extends between the pair of roller chain sections 5. Pin 2 extends through one chain section 5, then through segment 1, before passing through the other section 5. A series of roller bearings 3 support segments 1 as they ride on platen 4.

Simultaneous pressing and heating, as practised by existing processes, is feasible in this press. However, it is advantageous to heat and plasticize the wood assembly before pressing is commenced. Since, in such a situation, the heated wood assembly 7 entering the press may contain a thermo-setting glue, the gluelines in the assembly 7 must be closed and placed under minimum pressure as soon as possible to ensure adhesion. The sprocket 8 in FIG. 5, which depicts a side elevation, partial section view of the forward end of press assembly 16, illustrates how this is done. The front-most side chain 5, toothed roller chain sprocket 6 is not seen in FIG. 5 since it is a partial section view taken behind these components. The wood composite assembly 7 contacts the sprocket 8 first and this imparts an initial rapid compression action to the assembly 7 (as shown by the curved parallel lines). The diameter of the head sprocket 8 must be sufficiently large to prevent development of excessive stresses in the wood fibres of the wood components of the assembly 7. The convex constant-radius curvature of the press profile, which follows downstream from the sprocket 8, continues the compression action of the assembly at very slow rate thereby permitting continuous stress relaxation to occur within the wood. Again, it will be recognized that for purposes of illustration, the curvature of the press profile is exaggerated.

Figure 5:
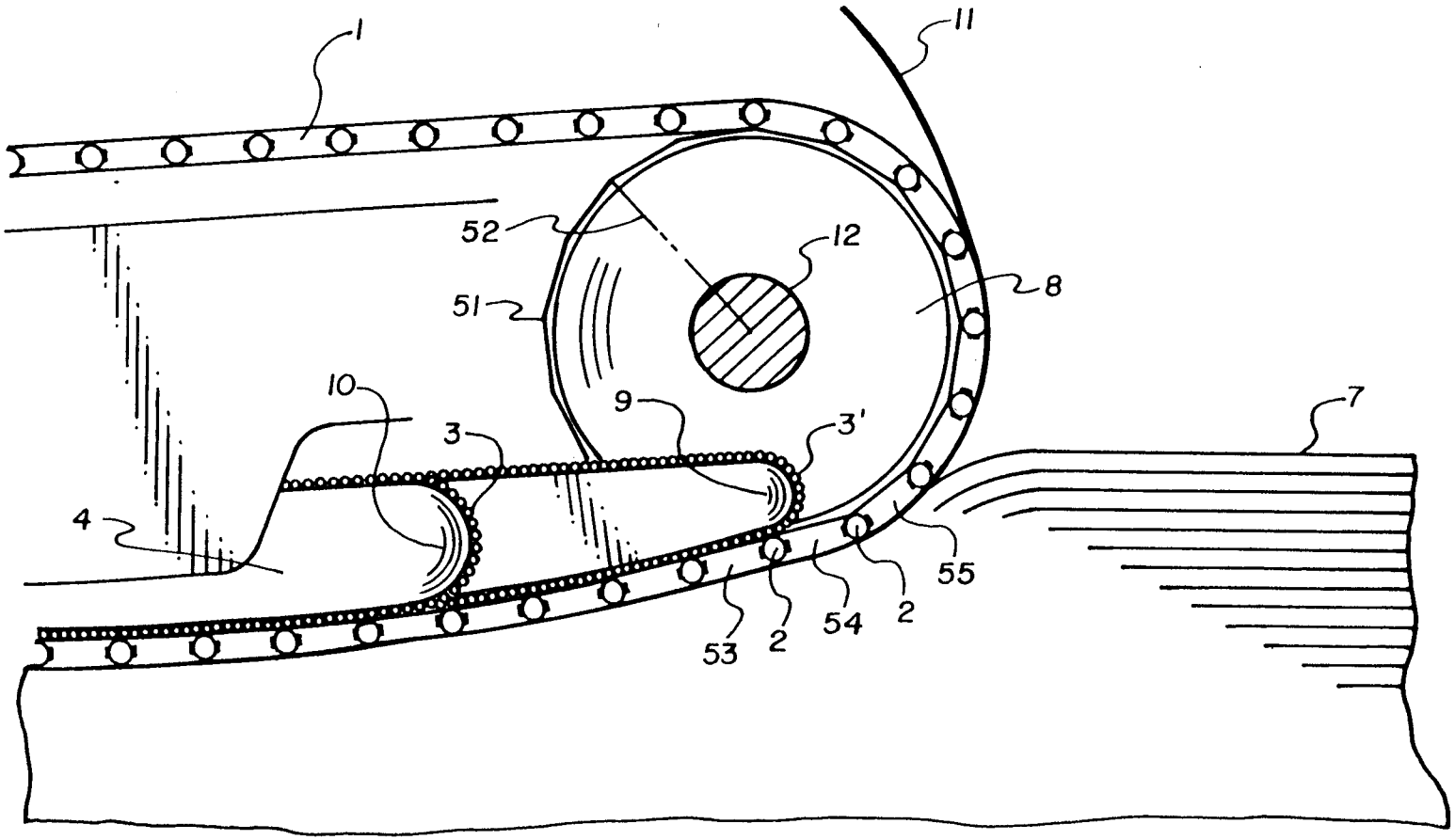
FIG. 5 depicts a side elevation partial section view of the dual length antifriction bearing chains.

The shorter nose bar 10 provides the turn-around hub for bearing chain 3. Nose bar 9 provides the turn-around hub for bearing chain 3'. The length and position of nose bar 9 is such that, when the tangent point between the nose bar 9 and the curvature of the platen 4 coincide on a radius 52 extending between any apex point of the sprocket 8, profile 51 and the centre of the sprocket 8 and shaft 12, the profile 51 is a natural extension of the track's curvature. FIG. 5 effectively illustrates this position but should be reviewed together with FIG. 6. As shown in FIG. 5, link 54 is initiating the transition motion. Link 53 has completed its transition action and is firmly seated on bearing chain 3'. Segment link 55 remains seated on the sprocket 8 until it reaches the position occupied by segment link 54 (as shown in FIG. 5). Link 54 has no support of its own until it reaches the position occupied by link 53. During this transition stage, the support for the link 54 is provided by adjacent pins 2 which are securely seated between links 53, 54 and 55. This transition phase takes place at the beginning of compression, where the compression force is still low. Therefore, although the links 53 and 55 are required to momentarily carry an increased load (as seen in FIG. 5), and the fact that there are only, approximately, half of the bearing chains, namely chains 3', supporting the links does not impede the reliable operation of the press.

As seen in FIG. 5, sprockets 8 are provided with a series of slightly concave profiles 51 around their circumferences. The stretches between the high points 52 of the concave profiles 51 have the same degree of curvature as the segments 1. Therefore, while riding on the sprockets 8, each similarly curved track segment 1 is firmly supported. Since the toothed roller chain sprockets 6 (not seen in FIG. 5 but seen in FIG. 1) are an integral part of the front and rear sprockets 8 and 15 and are mounted on common shafts 12 and 23 respectively in correct location in direct relation to sprockets 8, the positions of parallel roller chains 5 in turn ensure correctness of respective location of the segments 1 on respective profiles 51 of sprocket 8 at all times. FIG. 5 also illustrates the manner in which segment links 53, 54 and 55, in series, are correctly guided to coincide with roller bearing means 3 and 3' as they travel around the respective curved nose bars 10 and 9 of platen 4.

It is understood that it is possible to substitute any of the curved surfaces described above with a straight edge, or other suitable surfaces, without departing from the scope of the present invention.

As shown in FIG. 5, a belt 11 may be used with the chain-track system 1 to provide sealing means between the compressible wood assembly 7 and the track system 1. Such a belt 11 can be made of thin steel or other suitable materials that are flexible and compatible with the overall pressing process.

Figure 6:
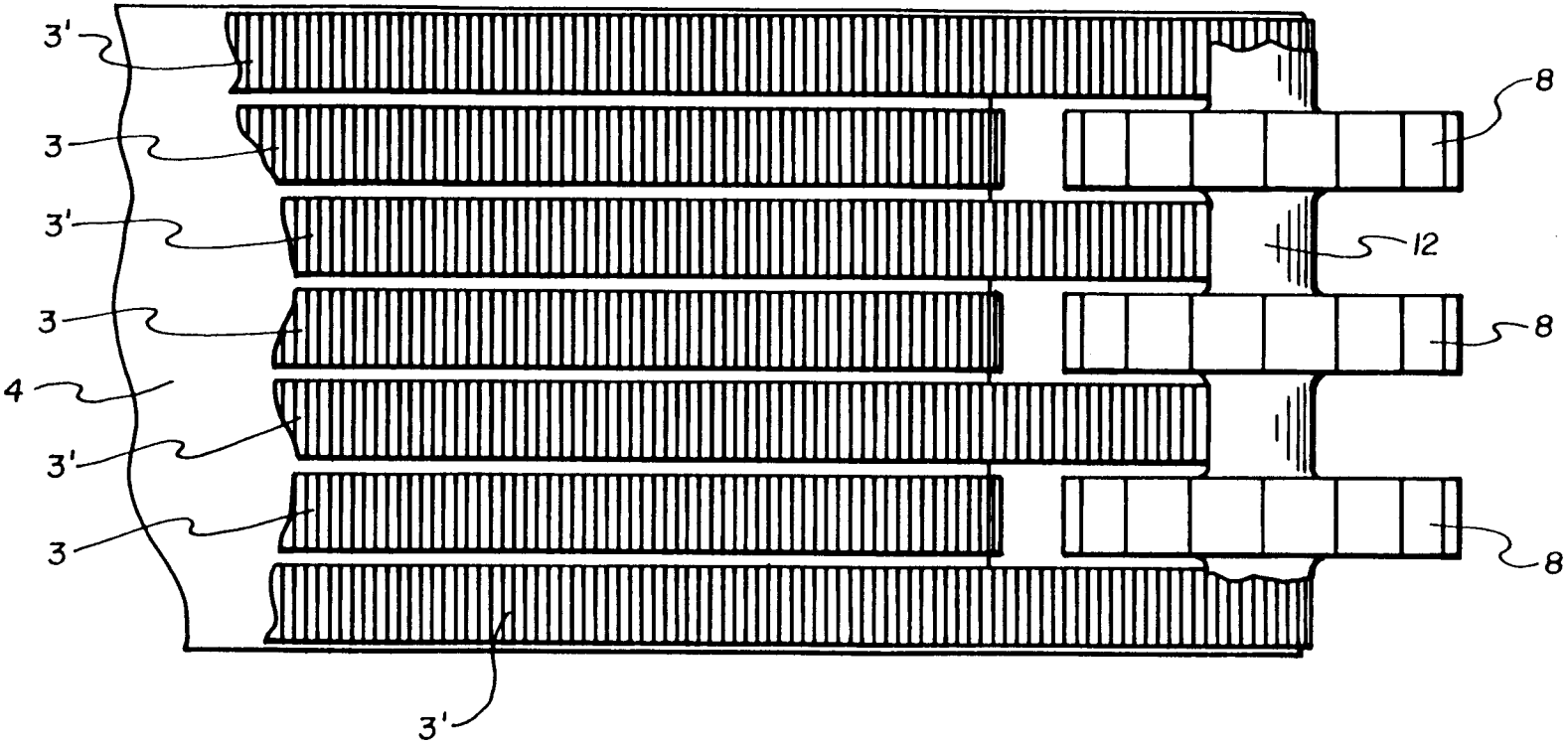
FIG. 6 represents a plan view of the bearing chains and the transition section of the assembly.

FIG. 6 depicts a plan view of the roller bearings 3 and 3' and sprockets 8 combination. The forward rotating surface comprises a plurality of sprockets 8 mounted on a common lateral shaft 12. Sprockets 8 are of a width somewhat narrower than the widths of the respective antifriction bearing chains 3, which they lead. The alternating bearing chains 3 and 3' are of two different lengths. The spacing between the sprockets 8 is such that each longer bearing chain 3' can extend between a portion of adjacent sprockets 8. The shorter bearing chains 3 are aligned downstream from the respective sprockets 8 and clear the sprockets 8. The alternating chains 3' pass between the sprockets 8. The platen 4 is the stationary bearing surface and has two sets of nose bars (see also FIG. 5).

Figure 8:
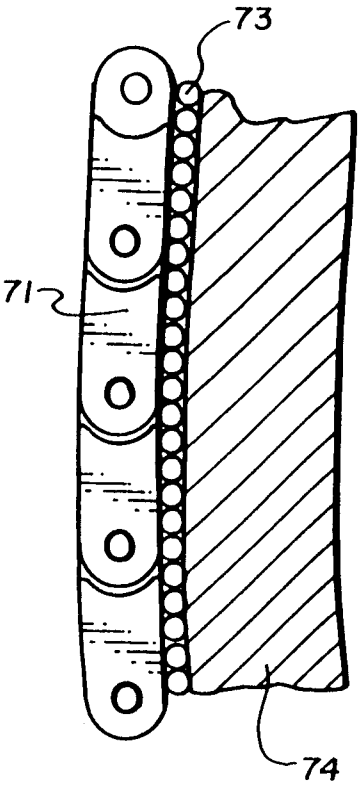
FIG. 8 illustrates a side view of the caterpillar conveyor depicted in FIG. 7.
Figure 7:
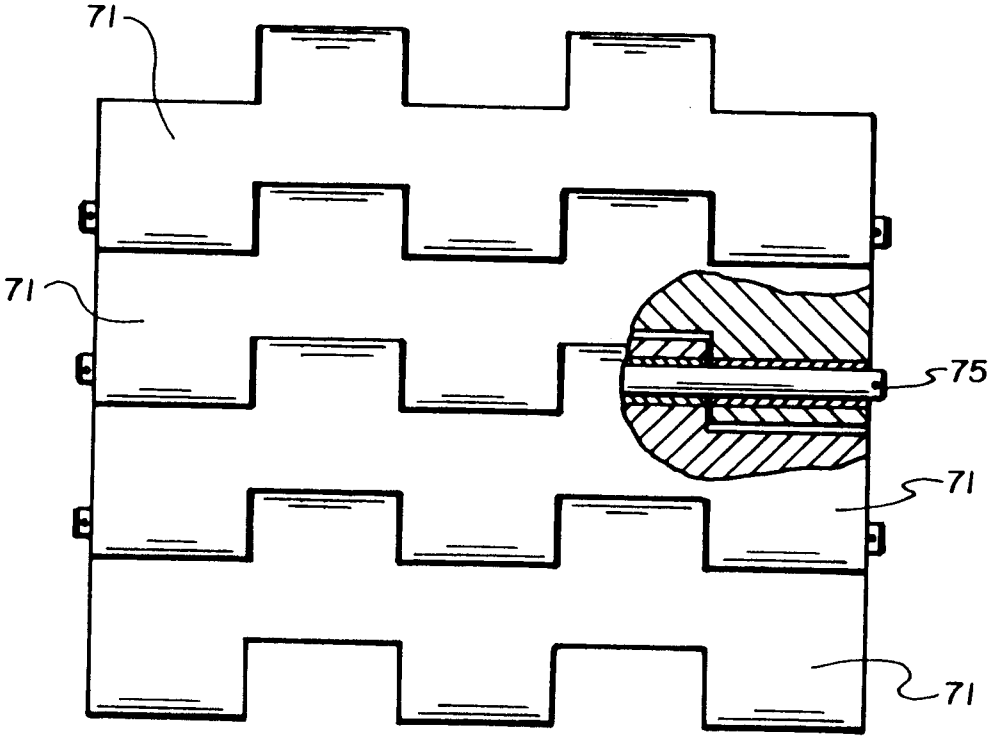
FIG. 7 depicts a plan view of an alternative arrangement of curved caterpillar conveyor.

In an alternative less preferred embodiment of the invention, as illustrated in FIGS. 7 and 8, the chain-track assembly can be replaced by a caterpillar conveyor chain that has a series of notched links 71 interconnected by pins 75. The surfaces of these links 71 are machined to conform to the constant-radius curvature of platen 74 (see FIG. 8). Antifriction roller bearings 73 (see FIG. 8) are located between the press platen 74 and the conveyor links 71. Driving a conveyor of this design requires significant initial tension in the conveyor to ensure that it does not slip on the drive pulley. This increases power requirements the stress within the mechanical components.

Figure 9:
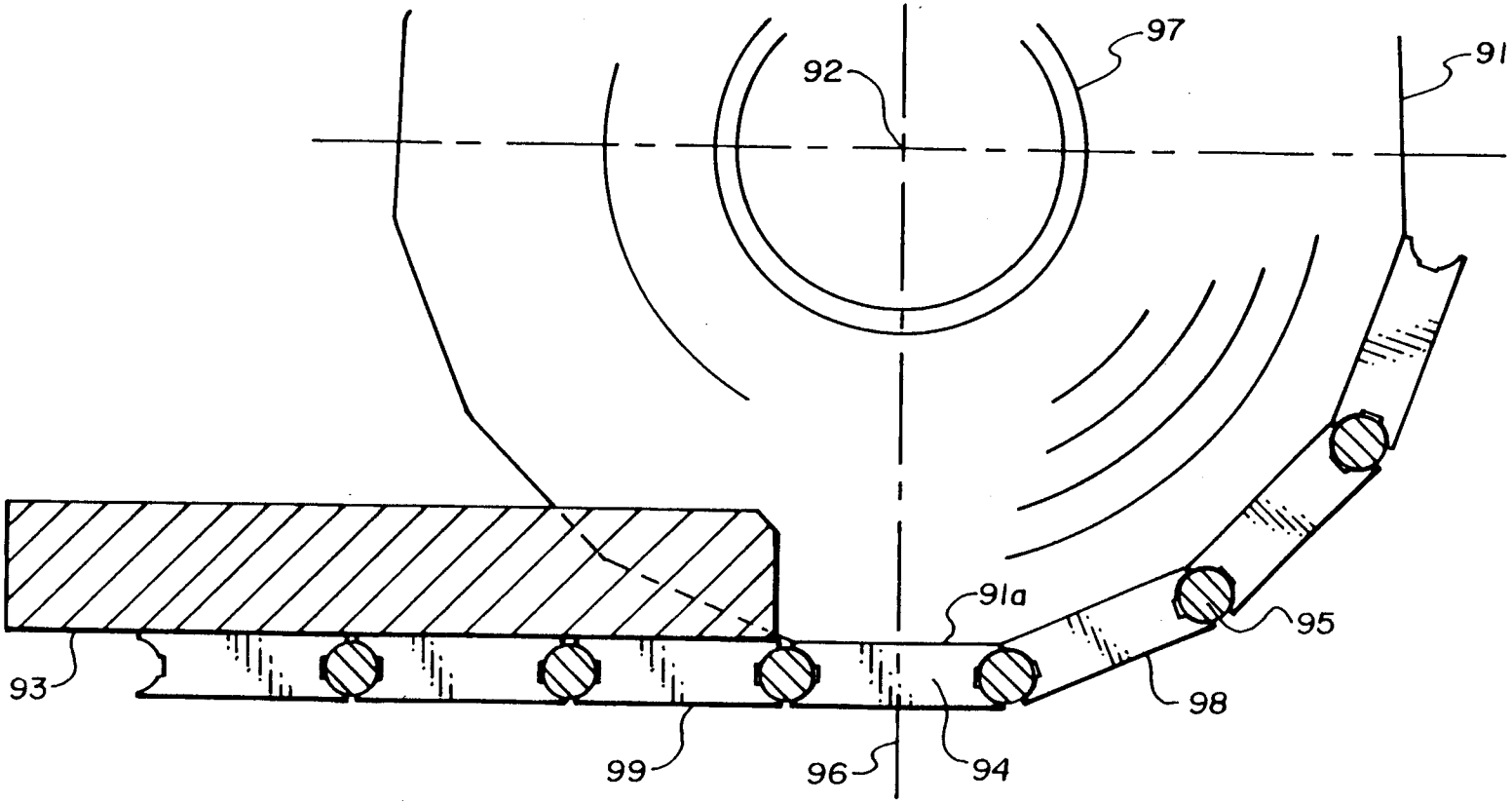
FIG. 9 illustrates schematically the principle of supporting a track segment through a transition between two different curvatures.

As explained previously in association with FIG. 5, this invention addresses the longstanding problem of achieving a load transition between two curved intersecting trajectories. To assist in understanding, the solution provided by the invention is illustrated in a schematic way in FIG. 9. Surface 91 rotates about centre 92 of shaft 97. Surface 93 is stationary and the track segments 94 forming the track system slide on this surface. Surface 91 has a scalloped profile corresponding to the series shape of the track segments 94 enveloping it around its circumference, such that the track segments 94 are fully supported while located on the surface 91. The track segments 94 are formed so that they have the same curvature as surface 93, such that when segments 94 are sliding on surface 93, they are fully supported. For simplicity, the curvature of the surface 93 in FIG. 9 is shown as infinite, that is, a straight line. During the transition of each segment 94 from the seat on surface 91 to its full location on the surface 93, a segment undergoes a complex motion that is a combination of translation and rotation. During this transition, the segment 94 cannot be directly supported. But the problem of transition and support can be solved by supporting the segment 94 during transition by relying upon the neighbouring segments 98 and 99 (as shown in FIG. 9). This is achieved by mutually correctly locating the two supporting surfaces 91 and 93 and by providing round pins 95 located in the concave ends of adjacent segments for enabling a segment to pivot about its ends in relation to its adjoining track segments. As FIG. 9 shows, the surface 91 is positioned relative to the surface 93 such that segment 94, at the start of the transition, is in alignment with the surface 93 but is still fully seated on the surface 91*a*. The centre of rotation 92 of the surface 91*a* lies on the radial line 96 that it is dividing the sliding surface of the segment 94 into two identical halves. In other words, they are mirror images of each other about radial line 96. Segment 94, at the position shown in FIG. 9, is tangentially aligned with the bottom surface of surface 93, and no wobbling or lateral movement occurs as segment 94 is moved onto the bottom surface of surface 93. Although the above explanation assumes direction of motion from the rotating surface to the stationary surface, it is understood that the transition motion can take place in either direction.

A similar solution can be applied in the case where both supporting surfaces are stationary but with different radii of curvature. In such a case, the segments are required to slide on both surfaces and also be fully supported on either. This can be accomplished by providing each track segment with both curvatures such that each curvature occupies alternatively a narrow section of the segment's length. The length of a track segment then has a plurality of sections that alternate between the two curvatures. The two supporting surfaces are made in sections and these are positioned such that they are aligned with sections on the segments having the corresponding curvature. The platen sections with the second curvature begin at the location where the first platens end, and the sections are staggered relative to each other. For location of the centres of curvature in respect to each other, the same considerations apply as in the case of a rotating surface.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for continuously pressing an uncompressed assembly of wood elements into a compressed wood assembly comprising:

(a) upper and lower frame means, the upper frame means supporting an upper press platen and the lower frame means supporting a lower press platen, the upper and lower press platens facing each other and having their entire facing surfaces formed into respective curved shapes of constant radius, the facing surfaces defining a converging inlet opening, and a diverging outlet opening, the inlet opening being adapted to receive the uncompressed assembly of wood elements and the diverging outlet opening being adapted to provide an outfeed for the compressed wood assembly;

(b) upper and lower converging endless track means, the upper endless track means adapted to travel along and conform to the curved surface of the upper press platen and the lower endless track means adapted to travel along and conform to the curved surface of the lower press platen;

(c) upper and lower antifriction means, the upper antifriction means located between the curved surface of the upper press platen and the upper track means and the lower antifriction means located between the curved surface of the lower press platen and the lower track means; and (d) power means for moving the upper and lower track means in a common direction between the upper and lower press platens.

2. An apparatus according to claim 1 wherein the power means consists of a pair of endless chain means, the pair of endless chain means being located on opposite ends of common pins and being held in place by the pins, each pin extending between and supporting two neighbouring track means.

3. An apparatus according to claim 2 wherein the track means consist of a series of adjacent separate segments having in the facing surfaces therebetween locating seats for the pins, the faces of the segments facing the press platens being formed to have a radius corresponding to the radius of the pressing means.

4. An apparatus according to claim 3 wherein the endless track means is located between the pair of endless chain means and the pins secure the pair of endless chain means to the endless track means and retain the segments in an endless loop assembly.

5. An apparatus according to claim 1 wherein the press platens is composed of a plurality of separate sections.

6. An apparatus according to claim 1 wherein the endless chain means is a caterpillar track conveyor having conveyor links formed to a constant radius curvature conforming to the curvature of the press platens.

7. An apparatus according to claim 6 wherein the radius of curvature of the press platens is at least 300 feet.

8. An apparatus according to claim 4 wherein sealing means are located on the exterior surface of the track means.

9. An apparatus according to claim 8 wherein the sealing means is a thin flexible steel belt.

10. An apparatus according to claim 4 wherein the radius of curvatures of the upper and lower press platens is about equal.

11. An apparatus according to claim 1 wherein the facing press platens define a constantly curved converging section from the press inlet opening to a point of maximum convergence between the inlet opening and the outlet opening, and a constantly curved diverging section from the maximum convergence point to the press outlet opening.

12. An apparatus according to claim 1 wherein the compression rate created by the converging inlet opening is generally proportional to the internal wood strain relaxation rate of the wood assembly as the wood assembly is compressed.

* * * * *